US006536883B2

(12) United States Patent
Hawkins et al.

(10) Patent No.: US 6,536,883 B2
(45) Date of Patent: Mar. 25, 2003

(54) CONTINUOUS INK-JET PRINTER HAVING TWO DIMENSIONAL NOZZLE ARRAY AND METHOD OF INCREASING INK DROP DENSITY

(75) Inventors: Gilbert A. Hawkins, Mendon, NY (US); Christopher N. Delametter, Rochester, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 76 days.

(21) Appl. No.: 09/785,618

(22) Filed: Feb. 16, 2001

(65) Prior Publication Data

US 2002/0113849 A1 Aug. 22, 2002

(51) Int. Cl.[7] ..... B41J 2/105
(52) U.S. Cl. ..... 347/77; 347/82
(58) Field of Search ..... 347/34, 55, 73, 347/74, 77, 82

(56) References Cited

U.S. PATENT DOCUMENTS 3,701,998 A 10/1972 Mathis
3,709,432 A 1/1973 Robertson
4,190,844 A 2/1980 Taylor
6,074,045 A * 6/2000 Bergman et al. ..... 347/55
6,079,821 A * 6/2000 Chwalek et al. ..... 347/82
6,220,693 B1 * 4/2001 Bode et al. ..... 347/34

FOREIGN PATENT DOCUMENTS

EP 0 780 230 A 6/1997
EP 0 911 167 A 4/1999

* cited by examiner

*Primary Examiner*—Anh T. N. Vo
(74) *Attorney, Agent, or Firm*—William R. Zimmerli

(57) ABSTRACT

A continuous inkjet printing apparatus is provided. The apparatus includes a printhead having a two dimensional nozzle array. The two dimensional nozzle array includes a first nozzle row being disposed in a first direction and a second nozzle row being disposed displaced and offset relative to the first nozzle row. A drop forming mechanism is positioned relative to the nozzle rows and is operable in a first state to form drops having a first volume travelling along a path and in a second state to form drops having a second volume travelling along the same path. A system applies force to the drops travelling along the path with the force being applied in a direction such that the drops having the first volume diverge from the path.

35 Claims, 11 Drawing Sheets

CONTINUOUS INK-JET PRINTER HAVING TWO DIMENSIONAL NOZZLE ARRAY AND METHOD OF INCREASING INK DROP DENSITY

CROSS REFERENCE TO RELATED APPLICATIONS

Reference is made to commonly assigned, co-pending U.S. Ser. No. 09/750,946, entitled Printhead Having Gas Flow Ink Droplet Separation And Method Of Diverging Ink Droplets, filed in the names of Jeanmaire and Chwalek on Dec. 28, 2000; co-pending U.S. Ser. No. 09/751,232, entitled A Continuous Ink-Jet Printing Method And Apparatus, filed in the names of Jeanmaire and Chwalek on Dec. 28, 2000; and Ser. No. 09/785,615, entitled Continuous Ink Jet Printhead Having Two-Dimensional Nozzle Array and Method of Redundant Printing, filed in the names of Hawkins, Delametter and Jeanmaire, concurrently herewith.

FIELD OF THE INVENTION

This invention relates generally to the design and fabrication of inkjet printheads, and in particular to the configuration of nozzles on inkjet printheads.

BACKGROUND OF THE INVENTION

Traditionally, digitally controlled inkjet printing capability is accomplished by one of two technologies. Both technologies feed ink through channels formed in a printhead. Each channel includes at least one nozzle from which droplets of ink are selectively extruded and deposited upon a medium.

The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of When print is desired, the ink droplets are not deflected and allowed to strike a print media. Alternatively, deflected ink droplets may be allowed to strike the print media, while non-deflected ink droplets are collected in the ink capturing mechanism.

Regardless of the type of inkjet printer technology, it is desirable in the fabrication of inkjet printheads to space nozzles in a two-dimensional array rather than in a linear array. Printheads so fabricated have advantages in that they are easier to manufacture. These advantages have been realized in currently manufactured drop-on-demand devices. For example, commercially available drop-on-demand printheads have nozzles which are disposed in a two-dimensional array in order to increase the apparent linear density of printed drops and to increase the space available for the construction of the drop firing chamber of each nozzle.

Additionally, printheads have advantages in that they reduce the occurrences of nozzle to nozzle cross talk, in which activation of one nozzle interferes with the activation of a neighboring nozzle, for example by propagation of acoustic waves or coupling. Commercially available piezoelectric drop-on-demand printheads have a two-dimensional array with nozzles arranged in a plurality of linear rows with each row displaced in a direction perpendicular to the direction of the rows. This nozzle configuration is used advantageously to decouple interactions between nozzles by preventing acoustic waves produced by the firing of one nozzle from interfering with the droplets fired from a second, neighboring nozzle. Neighboring nozzles are fired at different times to compensate for their displacement in a direction perpendicular to the nozzle rows as the printhead is scanned in a slow scan direction.

Attempts have also been made to provide redundancy in drop-on-demand printheads to protect the printing process from failure of a particular nozzle. In these attempts, two rows of nozzles were located aligned in a first direction, but displaced from one another in a second direction. The second direction being perpendicular to the first direction. There being no offset between the nozzle rows in the first direction, a drop from the first row could be printed redundantly from a nozzle from the second row.

However, for continuous inkjet printheads, two dimensional nozzle configurations have not been generally practiced successfully. This is especially true for printheads having a single gutter.

Typically, conventional continuous inkjet printheads use only one gutter for cost and simplicity reasons. In addition, occasionally all ejected drops need to be guttered. As conventional gutters are made with a straight edge designed to capture drops from a linear row of nozzles, the gutter edge in prior art devices extends in a first direction which is in the direction of the linear row of nozzles. As such, traditionally, it has been viewed as impractical to locate nozzles displaced in a second direction, substantially perpendicular from the first direction, because it would be difficult to steer or deflect drops from nozzles so located into the gutter. This is because the ability to steer or deflect drops has typically been limited to steering or deflecting of less than a few degrees; therefore, the maximum displacement of a nozzle in the second direction would be so limited that to date it has been impractical to implement.

Attempts have also been made to modify gutter shape to accommodate two dimensional nozzle arrays. U.S. Patent application entitled *Continuous Inkjet Printhead Having Serrated Gutter,* commonly assigned, discloses a gutter positioned adjacent a nozzle array in one direction and displaced from the nozzle array in another direction. An edge of the gutter is non-uniform with portions being displaced or extended relative to other portions. This configuration allows the gutter to capture ink drops from a two dimensional nozzle array. The gutter portions form a serrated profile which allow ink drops to be captured without having to deflect the ink drops through large deflection angles. When using this gutter configuration a deflection angle of about 2 degrees is required for ink drops to be captured by the gutter. Heretofore, large deflection angles, e.g. deflection angles exceeding 5 to 10 degrees, have not been possible.

Although the above described gutter works extremely well for it intended purpose, the design of a non-uniform gutter complicates its manufacture in comparison with a gutter having a straight edge. As such, cost associated with non-uniform gutters is also increased.

The invention described in U.S. Patent Application entitled *Printhead Having Gas Flow Ink Droplet Separation And Method Of Diverging Ink Droplets,* filed concurrently herewith and commonly assigned, discloses a printing apparatus having enhanced ink drop steering or deflection angles. The apparatus includes an ink droplet forming mechanism operable to selectively create a ink droplets having a plurality of volumes travelling along a path and a droplet deflector system. The droplet deflector system is positioned at an angle with respect to the path of ink droplets and is operable to interact with the path of ink droplets thereby separating ink droplets having one of the plurality of volumes from ink droplets having another of the plurality of volumes. The ink droplet producing mechanism can include a heater that may be selectively actuated at a plurality of frequencies to create the ink droplets travelling along the path. The droplet deflector system can be a positive pressure air source positioned substantially perpendicular to the path of ink droplets.

With the advent of a printing apparatus having enhanced ink drop steering or deflection, a continuous inkjet printhead and printer having multiple nozzle arrays capable of providing increased printed pixel density; increased printed pixel row density; increased ink levels of a printed pixel; redundant printing; reduced nozzle to nozzle cross-talk; and reduced power and energy requirement with increased ink drop deflection would be a welcome advancement in the art.

SUMMARY OF THE INVENTION

An object of the present invention is to reduce energy and power requirements of a continuous ink jet printhead and printer.

Another object of the present invention is to provide a continuous inkjet printhead having one or more nozzle rows displaced in a direction substantially perpendicular to a direction defined by a first row of nozzles.

Another object of the present invention to provide a continuous inkjet printhead having increased nozzle to nozzle spacing.

Another object of the present invention to provide a continuous inkjet printhead that reduces the effects of coupling and cross-talk between ink drop ejection of one nozzle and ink drop ejection from a neighboring nozzle.

It is yet another object of the present invention to provide a continuous inkjet printhead that simultaneously prints ink drops on a receiver at locations displaced from other printed ink drops.

It is yet another object of the present invention to provide a continuous inkjet printhead having nozzle redundancy.

It is yet another object of the present invention to provide a continuous inkjet printhead and printer that increases the density of printed pixels.

It is yet another object of the present invention to provide a continuous inkjet printer that increases printed pixel density in a printed row by printing additional ink drops after neighboring printed ink drops have been partially absorbed by a receiver.

It is yet another object of the present invention to provide a continuous inkjet printhead and printer that increases ink levels of a pixel on a receiver.

According to a feature of the present invention, a continuous inkjet printing apparatus includes a printhead having a two dimensional nozzle array with the two dimensional nozzle array having a plurality of nozzles. A drop forming mechanism is positioned relative to the nozzles and is operable in a first state to form drops having a first volume travelling along a path and in a second state to form drops having a second volume travelling along the same path. A system applies force to the drops travelling along the path with the force being applied in a direction such that the drops having the first volume diverge from the path.

According to another feature of the present invention, a continuous inkjet printing apparatus includes a printhead having a two dimensional nozzle array. The two dimensional nozzle array includes a first nozzle row being disposed in a first direction and a second nozzle row being disposed displaced and offset relative to the first nozzle row. A drop forming mechanism is positioned relative to the nozzle rows and is operable in a first state to form drops having a first volume travelling along a path and in a second state to form drops having a second volume travelling along the same path. A system applies force to the drops travelling along the path with the force being applied in a direction such that the drops having the first volume diverge from the path.

According to another feature of the present invention, a method of increasing ink drop density of a printed line on a receiver includes forming a first row of drops travelling along a first path, some of the drops having a first volume, some of the drops having a second volume; forming a second row of drops travelling along a second path, some of the drops having a first volume, some of the drops having a second volume; causing the drops having the first volume from the first and second rows of drops to diverge from the first and second paths; and causing the drops having the second volume from the first and second rows of drops to impinge on a location of the receiver.

According to another feature of the present invention, a continuous inkjet printing apparatus includes a printhead having two nozzle rows. Each nozzle row having a plurality of nozzles with a first nozzle row being displaced relative to a second nozzle row in a first direction and aligned relative to the second nozzle row in a second direction. A drop forming mechanism is positioned relative to the nozzles. The drop forming mechanism is operable in a first state to form drops having a first volume travelling along a path and in a second state to form drops having a second volume travelling along the path. A system applies force to the drops travelling along the path. The force is applied in a direction such that the drops having the first volume diverge from the path. The system is disposed such that the drops having the first volume and the second volume travel along distinct drop trajectories.

According to another feature of the present invention, a method of increasing ink drop density in a continuous inkjet printer having a two dimensional nozzle array includes forming a first row of drops travelling along a first path, some of the drops having a first volume, some of the drops having a second volume; forming a second row of drops travelling along a second path, some of the drops having a first volume, some of the drops having a second volume; causing the drops having the first volume from the first and second rows of drops to diverge from the first and second paths along distinct drop trajectories; and causing the drops having the second volume from the first and second rows of drops to impinge on predetermined areas on the receiver.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
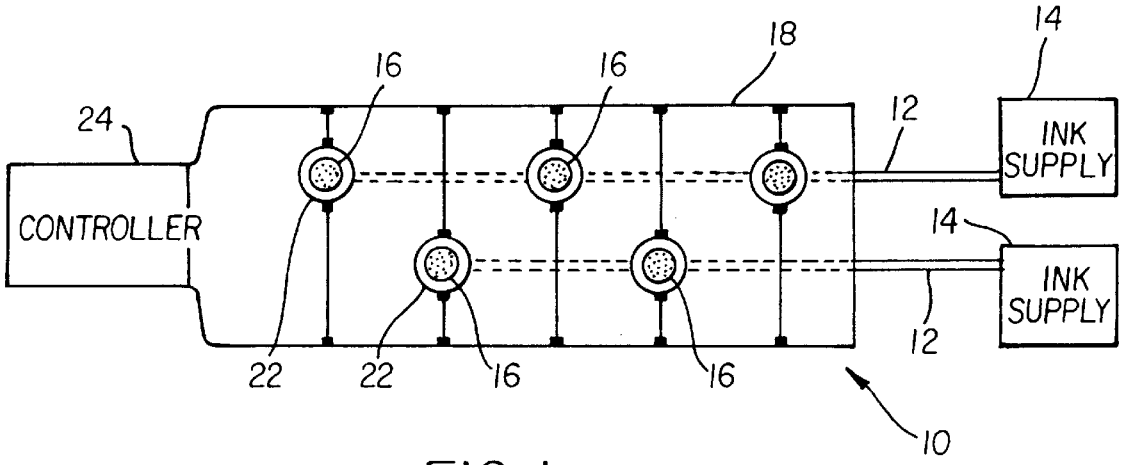
FIGS. 1*a* and 1*b* are a schematic view of an apparatus incorporating the present invention.
Figure 1B:
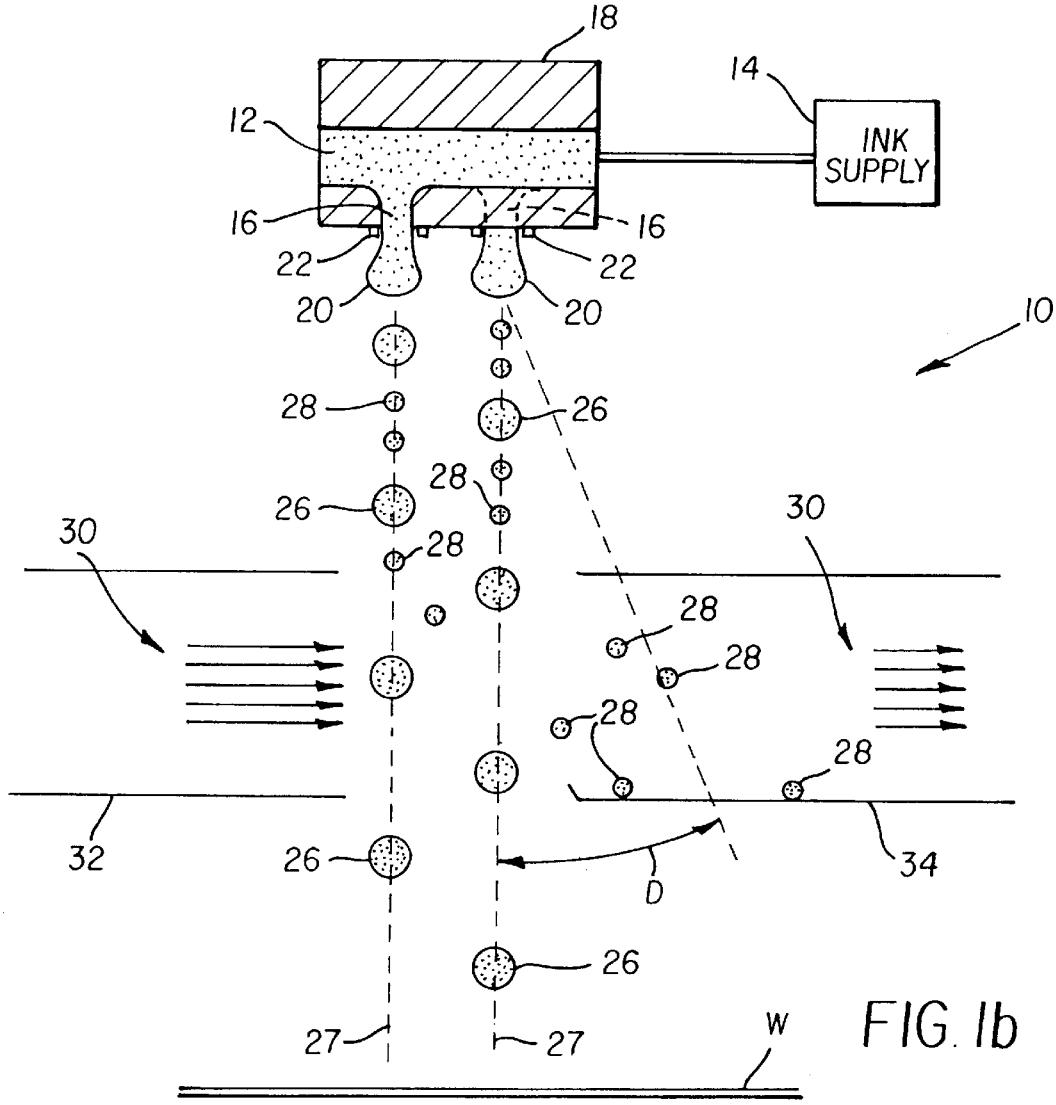

Referring to FIGS. 1*a* and 1*b*, an apparatus 10 incorporating the present invention is schematically shown. Although apparatus 10 is illustrated schematically and not to scale for the sake of clarity, one of ordinary skill in the art will be able to readily determine the specific size and interconnections of the elements of the preferred embodiment. Pressurized ink 12 from an ink supply 14 is ejected through nozzles 16 of printhead 18 creating filaments of working fluid 20. Ink drop forming mechanism 22 (for example, a heater, piezoelectric actuator, etc.) is selectively activated at various frequencies causing filaments of working fluid 20 to break up into a stream of selected ink drops (one of 26 and 28) and non-selected ink drops (the other of 26 and 28) with each ink drop 26, 28 having a volume and a mass. The volume and mass of each ink drop 26, 28 depends on the frequency of activation of ink drop forming mechanism 22 by a controller 24.

A force 30 from ink drop deflector system 32 interacts with ink drop stream 27 deflecting ink drops 26, 28 depending on each drops volume and mass. Accordingly, force 30 can be adjusted to permit selected ink drops 26 (large volume drops) to strike a receiver W while non-selected ink drops 28 (small volume drops) are deflected, shown generally by deflection angle D, into a gutter 34 and recycled for subsequent use. Alternatively, apparatus 10 can be configured to allow selected ink drops 28 (small volume drops) to strike receiver W while non-selected ink drops 26 (large volume drops) strike gutter 34. System 32 can includes a positive pressure source or a negative pressure source. Force 30 is typically positioned at an angle relative to ink drop stream 24 and can be a positive or negative gas flow.

Figure 2A:
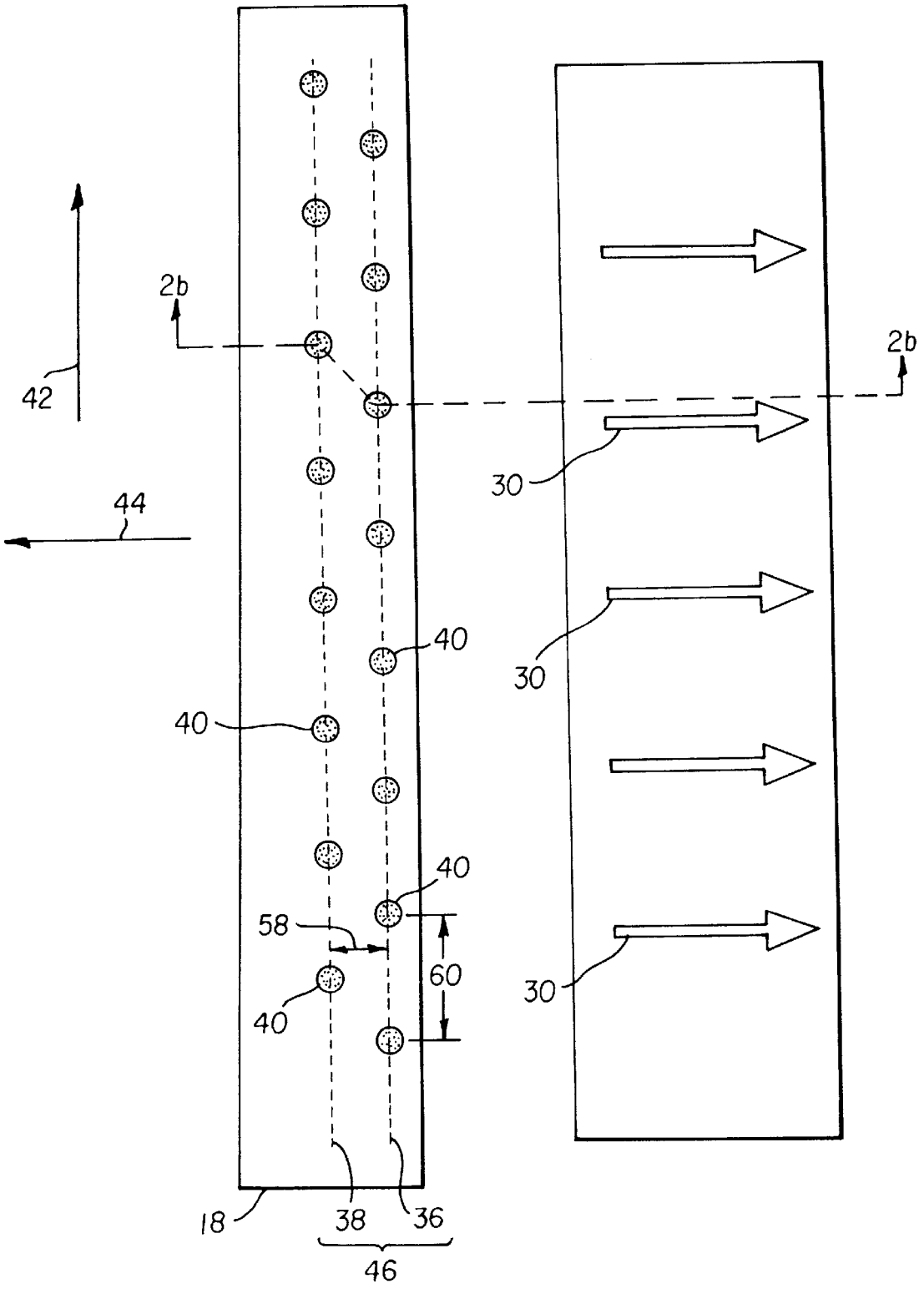
FIG. 2*a* is a schematic top view of a continuous ink jet printhead having a two dimensional nozzle array and a gas flow selection device.

Referring to FIG. 2*a*, a schematic top view of printhead 18 is shown. Printhead 18 includes at least two rows 36, 38 of nozzles 40. Row 36 extends in a first direction 42, while row 38 extends along first direction 42 displaced in a second direction 44 from row 36. Typically, second direction 44 is substantially perpendicular or perpendicular to first direction 42. Row 38 is also offset in first direction 42 from row 36 with nozzles 40 of row 38 being positioned in between nozzles 40 of row 36. Rows 36, 38 form a two dimensional nozzle array 46 having staggered nozzles 40. A gutter 34 is positioned adjacent nozzle array 46 in second direction 44 and displaced from nozzle array 46 in a third direction 48 (shown in FIG. 2*b*). Force 30 is shown moving opposite second direction 44.

Figure 2B:
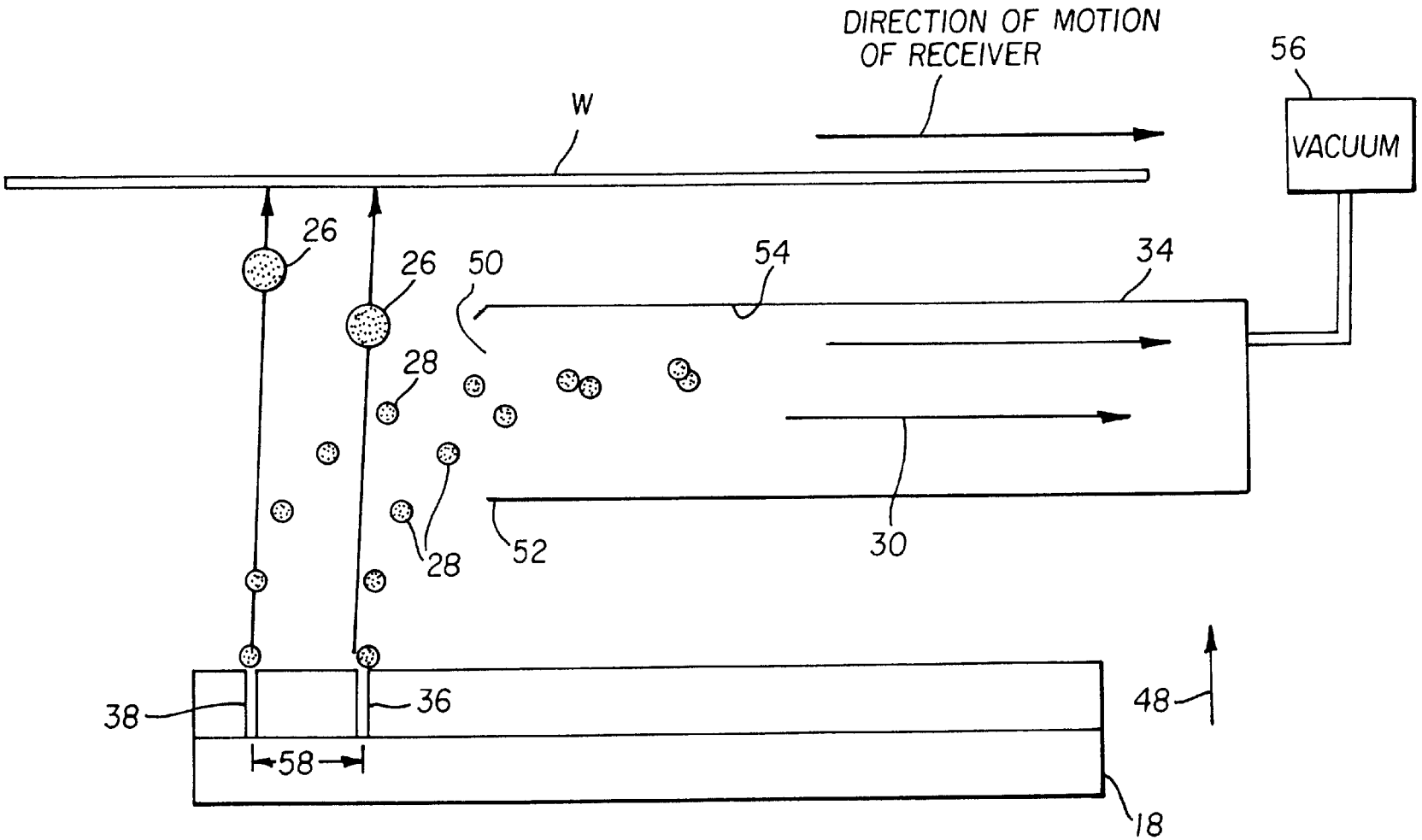
FIG. 2*b* is a schematic side view of the continuous ink jet printhead of FIG. 2*a;*

Referring to FIG. 2*b*, a schematic cross-sectional view taken along line AA in FIG. 2*a* is shown. Force 30 interacts with ink drops 26, 28 separating selected drops 26 from non-selected drops 28 by deflecting non-selected ink drops 28. Gutter 34 has an opening 50 along an edge 52 that allows non-selected drops 28 (non-printed ink drops) to enter gutter 34 and impinge on a gutter surface 54. Non-selected ink drops 28 can then be recycled for subsequent use or disposed of. A negative pressure or vacuum 56 can be included to assist with this process, as is typically practiced in continuous ink jet printing.

In operation, ink drops 26, 28 ejected from nozzles 40 are typically selected to be one of two sizes, selected ink drop 26 (printed drop, FIG. 2*b*) and non-selected ink drop 28 (guttered drop, FIG. 2*b*). Non-selected ink drops 28 are sufficiently small in volume to be deflected by system 30 and captured by gutter 34. Selected ink drops 26 are sufficiently large in volume to be deflected only slightly, if at all, thereby landing on receiver W, typically moving in first direction 42, commonly referred to as a fast scan direction. Alternatively selected ink drops 26 can be small in volume while non-selected ink drops 28 are large in volume. This can be accomplished by repositioning gutter 34 such that large volume drops are captured by gutter 34.

As shown in FIG. 2*b*, non-selected ink drops 28 follow trajectories that lead to gutter 34, regardless of whether non-selected ink drops 28 are ejected from nozzle row 36 or nozzle row 38. This is because system 32 creates large deflection angles D (up to 90 degrees depending on ink drop size) as system 32 interacts with selected and non-selected ink drops 26, 28. This allows spacing 58, 60 between nozzle rows 22, 24 to be increased. The ability to increase nozzle spacing 58, 60 in a two dimensional array provides additional area for fabrication of each nozzle 40 which reduces nozzle to nozzle coupling or cross-talk.

For example, spacing 58, 60 increase between nozzles of as much as 0.1 to 1.0 mm can be achieved using system 32 having a height of about 2 mm. As flow of force 30 outside system 32 does not decrease substantially over a distance of about 0.2 times the height of system 32, a height for system 32 in the range of form 1 to 10 mm is typically preferred with a height of 2 mm typically practiced. For an apparatus 10 having high nozzle density, for example, a density of from 600 to 1200 dpi, as is currently practiced in the commercial art, the spacing 58, 60 of adjacent nozzles can be increased from about 20 microns to between 120 to 1000 microns. As many nozzle to nozzle cross-talk occurrences decrease rapidly with nozzle to nozzle separation (frequently in proportion to the square or cube of the separation distance), the reduction of nozzle to nozzle cross-talk can be very substantial, for example as much as an order of magnitude.

Figure 2C:
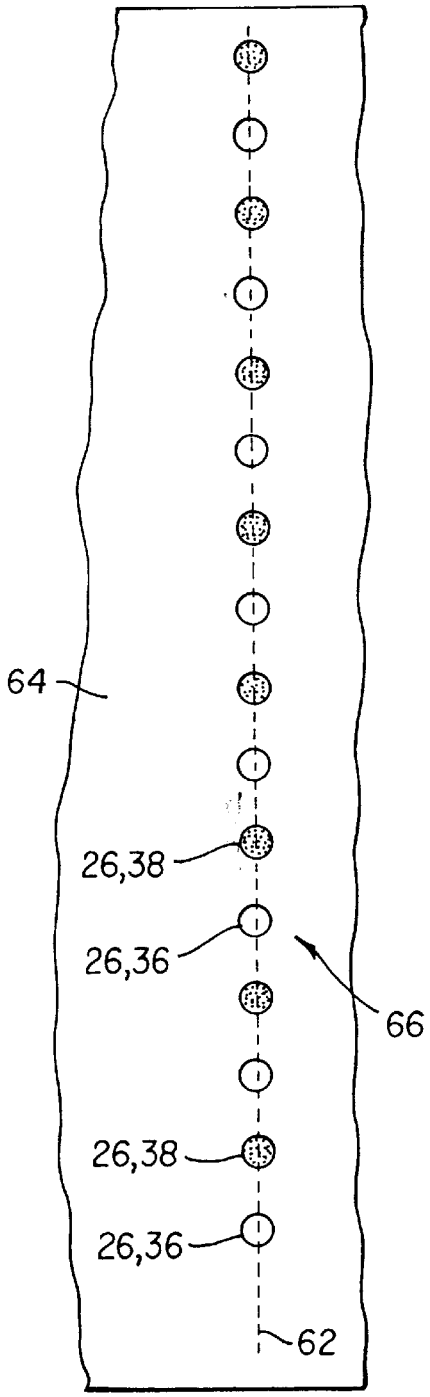
FIG. 2*c* is a schematic view of smaller printed droplets from a continuous inkjet printhead having the two dimensional array of nozzles and serrated gutter of FIG. 2*a;*
Figure 2D:
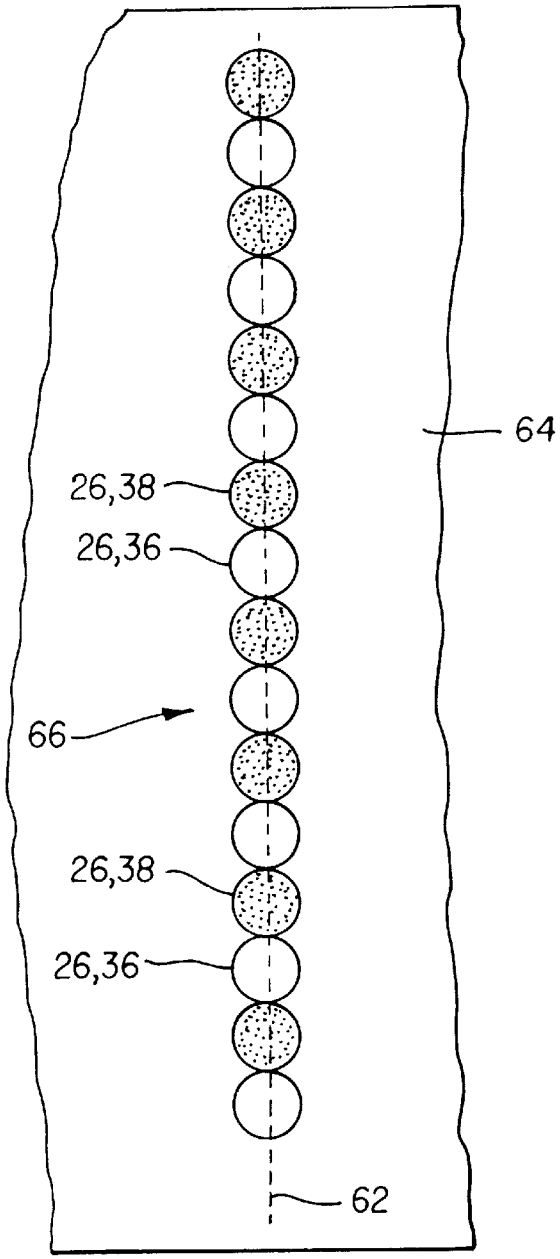
FIG. 2*d* is a schematic view of larger printed droplets from a continuous inkjet printhead having the two dimensional array of nozzles and serrated gutter of FIG. 2*a;*

Referring to FIGS. 2*c* and 2*d*, a representative print line 62 on a receiver 64 is shown. By appropriately timing the actuation of nozzle rows 36 and 38, ink drops 26 from the nozzle row 36 land on print line 62 on receiver 64 as do ink drops 26 from nozzle row 38, thus forming a row of printed drops 66. In FIG. 2*c*, ink drop sizes are smaller as compared to ink drop sizes in FIG. 2*d*. Ink drop size can be controlled by the frequency of activation of ink drop forming mechanism 22 by controller 24 in any known manner. Additionally, as shown by comparing FIGS. 2*c* and 2*d*, the size of printed ink drops can be varied such that printed ink drops do not contact each other (as in FIG. 2*c*) or contact each other (as in FIG. 2*d*).

Appropriately timing the actuation of nozzle rows 36 and 38, is typically accomplished using controller 24. Appropriate timing can be achieved by having ink drops 26 ejected from nozzle row 36 ejected earlier in time than ink drops 26 ejected from nozzle row 38. An application specific time separation can be calculated using a formula calculation that determines that the separation time multiplied by the velocity of the receiver with respect to the printhead equals the separation distance between the first and second nozzle rows 36, 38. This relation assumes that nozzle rows 36, 38 are positioned relative to each other sufficiently close such that system 32 displaces ink drops 26, 28 from nozzle rows 36, 38 equally or substantially equally. In this case, nozzle rows are typically separated by moderate distances (for example, distances in the range 10 to 100 microns). For example, given receiver velocities of about 1 m/s and nozzle row separations of about 100 microns, the difference in ejection times in accordance with the formula is about 100 microseconds. For nozzle row separations greater than 100 microns, the separation time calculated form the formula must be increased, due to the fact that the drops from the second row, being further from the end of system 32, experience slightly smaller interaction forces and are deflected less in the direction of receiver motion as compared to drops from the first row. This effect cannot be neglected and should be taken into consideration. For example, given a nozzle row separation of 1 mm, the additional actuation time to be added to the calculated separation time can be several time as large as the calculated separation time. This is because the distances by which drops are displaced by system 32 are as much as 1 mm for typical system velocities of about 1 m/s. The amount of such an increase in the calculated separation time can be readily modeled by the techniques of computational fluid dynamics by assuming the drops to be spheres moving in system 32. Alternatively, the increase can be easily determined emperically by adjusting the increase in separation time so that the ink drops 26 from the nozzle row 36 land on print line 62 on receiver 64 just as do ink drops 26 from nozzle row 38, thus forming a row of printed drops 66, as can be appreciated by one skilled in the art of flow modeling. Once a determination of the correct adjustment is made, its value can be stored for future reference.

Figure 3A:
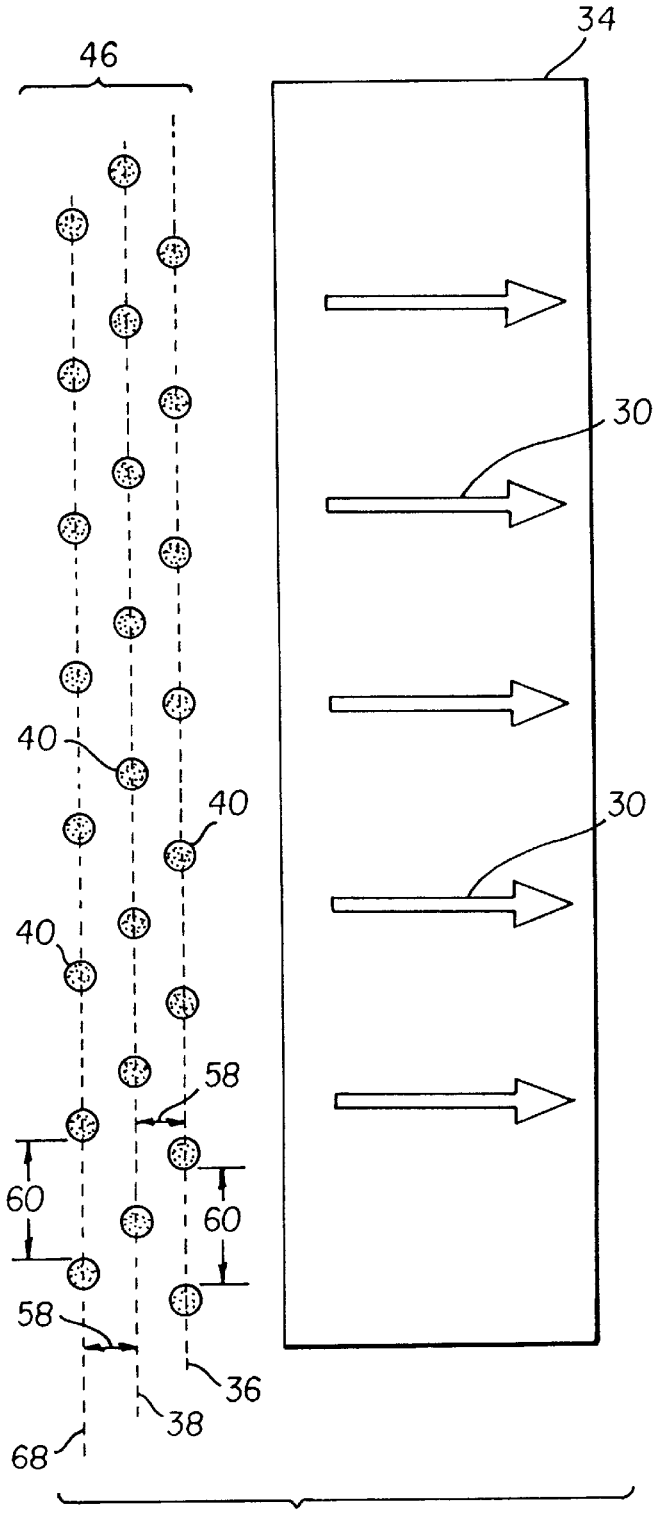
FIG. 3*a* is a schematic top view of an alternative embodiment of the invention shown in FIG. 2*a;*

Referring to FIG. 3*a*, a nozzle array 46 of three rows is shown. As such, the present invention is not limited to two nozzle rows and can incorporate any number of nozzle rows (e.g. two, three, four, five, six, seven, eight, etc.). In FIG. 3*a*, three staggered nozzle rows, nozzle row 36, nozzle row 38, and nozzle row 68 are spaced apart in second direction 44 substantially perpendicular to first direction 42. Nozzles 40 of rows 38, 68 are positioned between nozzles 40 of row 36. Typically, nozzle spacing is relative to nozzle row 36. However, nozzle spacing can be relative to any nozzle row 36, 38, 68. Each nozzle 40 in each nozzle row 36, 38, 68 is operable to eject selected and non-selected ink drops as described above. Again, non-selected ink drops follow trajectories that lead to gutter 34, regardless of which nozzle row non-selected ink drops originated from. Again, this is because system 32 creates large deflection angles (up to 90 degrees depending on ink drop size) as force 30 of system 32 interacts with selected and non-selected ink drops. This allows spacing between nozzle rows 36, 38, 68 to be increased. The ability to increase nozzle spacing in a two dimensional nozzle array provides additional area for fabrication of each nozzle 40. Increasing the distance between nozzles during fabrication reduces nozzle to nozzle cross-talk during printhead operation.

Figure 3B:
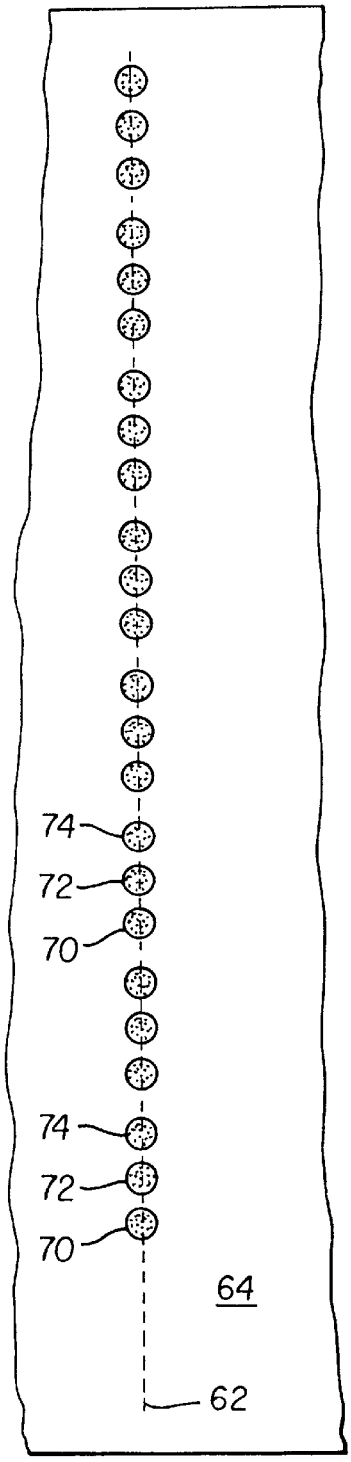
FIG. 3*b* is a schematic view of printed droplets from the embodiment shown in FIG. 3*a;*

Referring to FIG. 3*b*, a representative print line 62 on a receiver 64 is shown. By appropriately timing the actuation of nozzle rows 36, 38, 68 using controller 24 in a known manner, ink drops 70 from the nozzle row 36 land on print line 62 on receiver 64 as do ink drops 72, 74 from nozzle rows 36, 68, respectively, thus forming a row of printed drops 66. In FIG. 3*b*, ink drop sizes are smaller as compared to ink drop sizes in FIG. 2*d*. Ink drop size can be controlled by the frequency of activation of ink drop forming mechanism 22. Additionally, the size of printed ink drops can be varied such that printed ink drops do not contact each other (as in FIG. 3*b*) or contact each other (as in FIG. 2*d*).

Figure 4A:
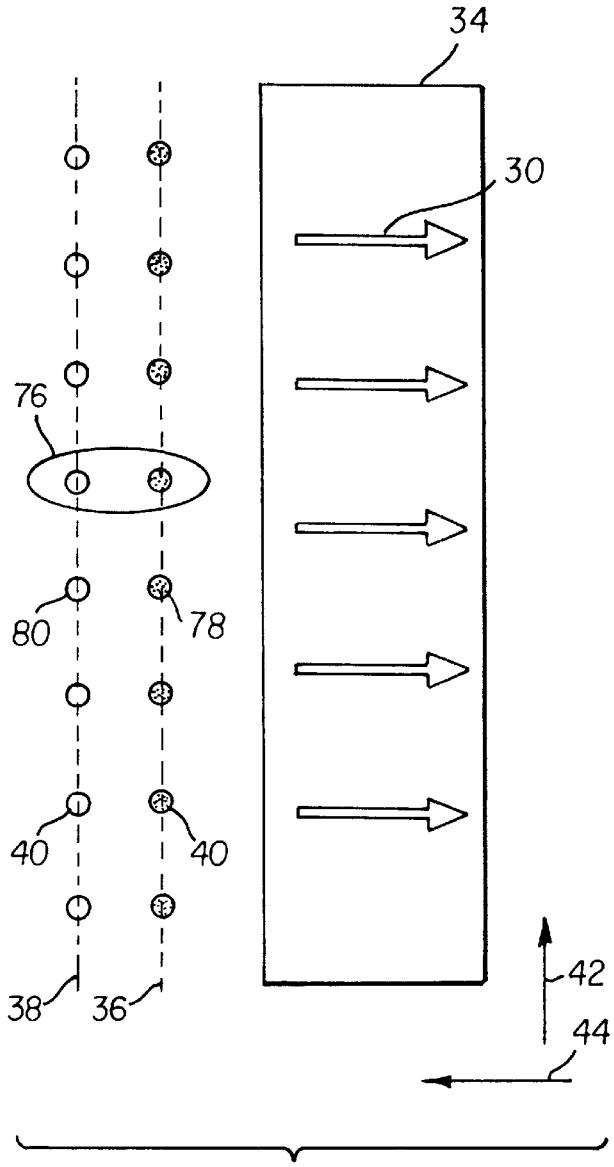
FIG. 4*a* is a schematic top view of an alternative embodiment of the invention shown in FIG. 2*a;*

Referring to FIG. 4*a*, two non-staggered nozzle rows 36, 38 are shown. In FIG. 4*a*, nozzle rows 36, 38 are similar to those of FIG. 2*a* but having no offset in first direction 42. As such, nozzles row 36, 38 can be configured to provide redundant printing in the event one or more nozzles 40 from any nozzle row 36, 38 fails during printing. Additionally, nozzles row 36, 38 can be configured to print multiple ink drops in the same location on receiver 64.

Figure 4B:
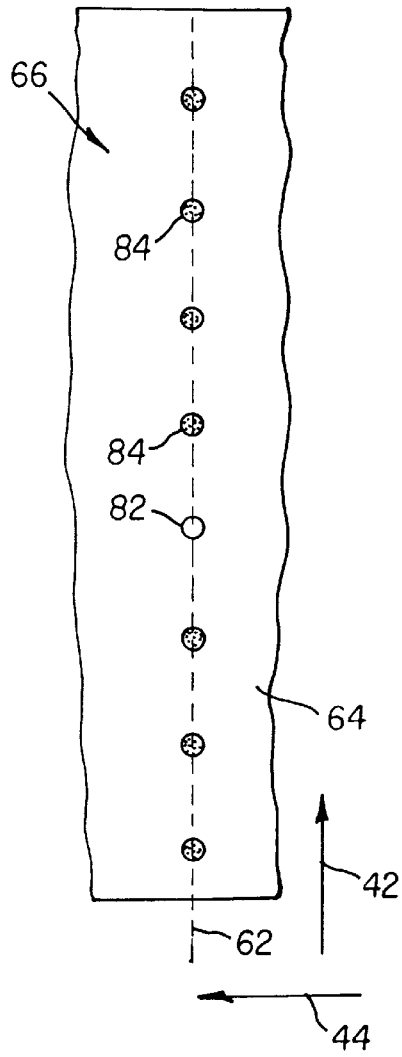
FIG. 4*b* is a schematic view of printed droplets from the embodiment shown in FIG. 4*a;*
Figure 4C:
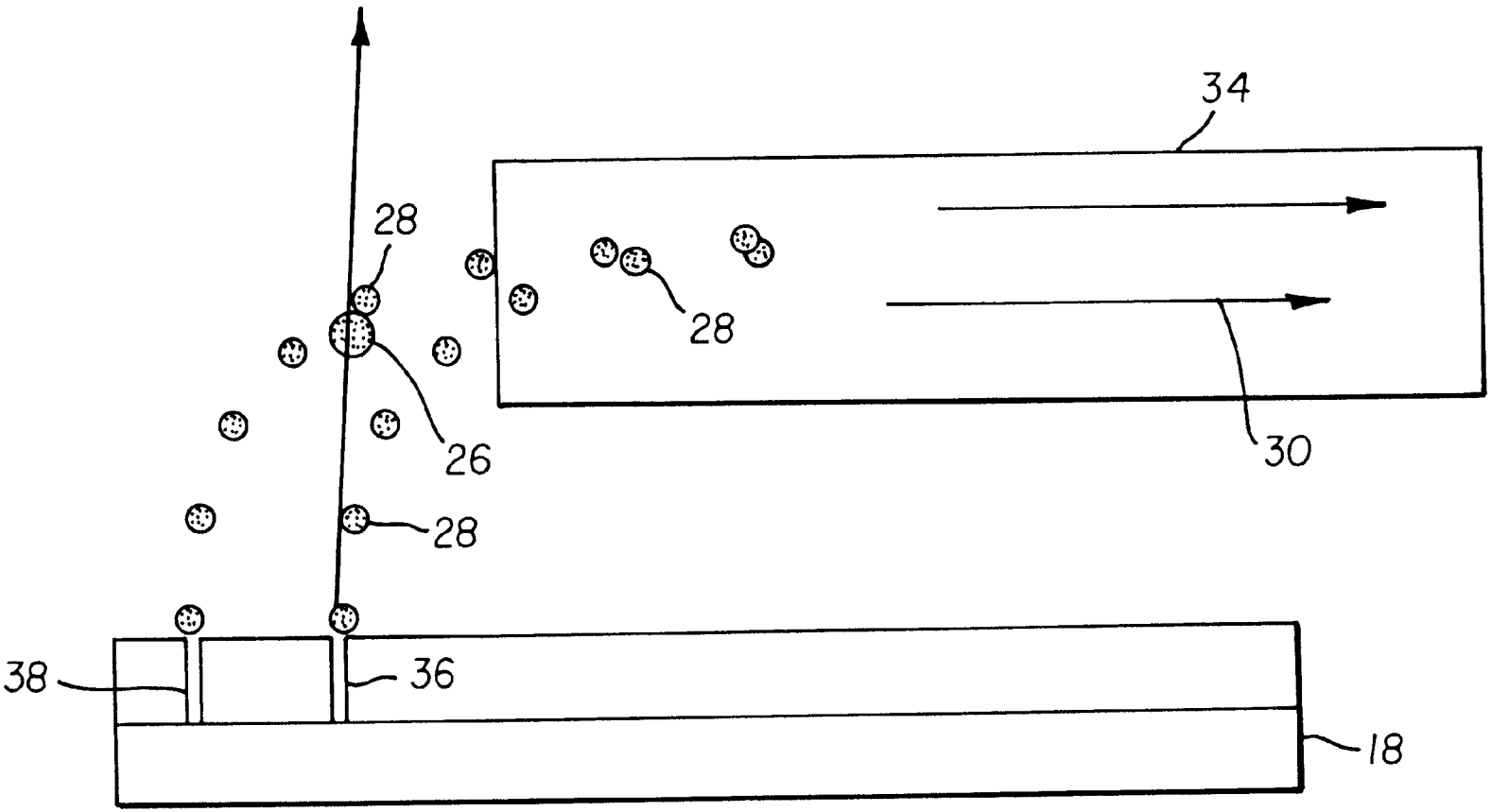
FIG. 4*c* is a schematic view illustrating ink droplet timing requirements for the invention shown in FIG. 4*a;*

Referring to FIG. 4*c*, non-selected ink drops follow trajectories that lead to gutter 34, regardless of which nozzle row non-selected ink drops originated from. This is because system 32 creates large deflection angles (up to 90 degrees depending on ink drop size) as force 30 of system 32 interacts with selected and non-selected ink drops. This allows spacing between nozzle rows 36, 38 to be increased. The ability to increase nozzle spacing in a two dimensional nozzle array provides additional area for fabrication of each nozzle 40. Increasing the distance between nozzles during fabrication reduces nozzle to nozzle cross-talk during printhead operation.

Again referring to FIG. 4*a*, nozzles 40 form redundant nozzle pairs 76 with nozzles 40 of nozzle row 38 being displaced in only second direction 44 relative to nozzles 40 from nozzle row 36. In this context, redundant nozzle pairs 76 compensate for individual nozzle 40 failures. As receiver 64 moves in either first or second direction 42, 44, each nozzle 40 in redundant nozzle pairs 76 is operable to compensate for the other nozzle 40 and print ink drops on the same location on receiver 64. Redundant nozzle pairs 76 can be fabricated on a printhead using MEMS techniques. In doing so, a precise alignment of the nozzles in redundant nozzle pairs is readily achieved since as these fabrication methods typically involve lithography, well known in the art to render accurate nozzle patterns on a single substrate of a single printhead.

Referring to FIG. 4*b*, a representative print line 62 on a receiver 64 is shown. By appropriately timing the actuation of nozzle rows 36, 38, ink drops 84 from nozzle row 36 land on print line 62 on receiver 64 as do ink drops 82 from nozzle row 38, forming a row of printed drops 66. Printed ink drops 82, 84 from nozzle rows 36, 38 land on receiver 64 in the same location. There is no printed ink drop displacement between nozzles rows 36, 38 in second direction 44.

Appropriately timing the actuation of nozzle rows 36 and 38, is typically accomplished using-controller 24. Appropriate timing can be achieved by having ink drops 26 ejected from nozzle row 36 ejected earlier in time than ink drops 26 ejected from nozzle row 38. An application specific time separation can be calculated using a formula calculation that determines that the separation time multiplied by the velocity of the receiver with respect to the printhead equals the separation distance between the first and second nozzle rows 36, 38. This relation assumes that nozzle rows 36, 38 are positioned relative to each other sufficiently close such that system 32 displaces ink drops 26, 28 from nozzle rows 36, 38 equally or substantially equally. In this case, nozzle rows are typically separated by moderate distances (for example, distances in the range 10 to 100 microns). For example, given receiver velocities of about 1 m/s and nozzle row separations of about 100 microns, the difference in ejection times in accordance with the formula is about 100 microseconds. For nozzle row separations greater than 100 microns, the separation time calculated form the formula must be increased, due to the fact that the drops from the second row, being further from the end of system 32, experience slightly smaller interaction forces and are deflected less in the direction of receiver motion as compared to drops from the first row. This effect cannot be neglected and should be taken into consideration. For example, given a nozzle row separation of 1 mm, the additional actuation time to be added to the calculated separation time can be several time as large as the calculated separation time. This is because the distances by which drops are displaced by system 32 are as much as 1 mm for typical system velocities of about 1 m/s. The amount of such an increase in the calculated separation time can be readily modeled by the techniques of computational fluid dynamics by assuming the drops to be spheres moving in system 32. Alternatively, the increase can be easily determined emperically by adjusting the increase in separation time so that the ink drops 26 from the nozzle row 36 land on print line 62 on receiver 64 just as do ink drops 26 from nozzle row 38, thus forming a row of printed drops 66, as can be appreciated by one skilled in the art of flow modeling. Once a determination of the correct adjustment is made, its value can be stored for future reference.

Again referring to FIGS. 4*a* and 4*b*, for example, a nozzle 78 in nozzle row 36 has become defective and failed. Nozzle failure can include many situations, for example, nozzle contamination by dust and dirt, nozzle actuator failure, etc. Detection of nozzle failure can be accomplished in any known manner. Printed ink drop line 62 can be printed on receiver 64 having ink drop spacing in first direction 42 equivalent to nozzle spacing 60 of nozzle rows 36, 38 with each printed drop originating from one member of each redundant nozzle pair 76. Either member of redundant nozzle pair 76 can compensate of the failure of the other. In the event one nozzle of redundant nozzle pairs 76 fails, for example, a nozzle 78 in nozzle row 36, as shown in FIG. 4*b*, a nozzle 80 from nozzle row 38 is used to print ink drop 82 in the designated printing location for that redundant nozzle pair on receiver 64. In FIG. 4*b*, other printed ink drops 84 originated from nozzle row 36. However, other printed ink drops 84 can originate from nozzles 40 in either nozzle row 36 or 38. As such, redundancy is provided to compensated failed nozzles.

Alternatively, by appropriately timing the actuation of nozzle rows 36, 38, ink drops 84 from nozzle row 38 land on print line 62 on receiver 64 as do ink drops 82 from nozzle row 36, forming a row of printed drops 66. Printed ink drops 82, 84 from nozzle rows 36, 38 land on receiver 64 in the same location. Additionally, there is no ink drop displacement between nozzles rows 36, 38. As such, nozzles row 36, 38 print multiple ink drops on the same location on receiver 64. The position of an ink drop from nozzle row 36 being concentric to the position of ink drop from nozzle row 38. This is described in more detail below with reference to FIGS. 7*a*–7*c*.

Referring to FIG. 4*c*, an important consideration in the operation of redundant nozzles is to avoid collisions between selected ink drops 26 from nozzle row 36 and non-selected ink drops 28 from nozzle row 38. FIG. 4*c* illustrates a preferred method of avoiding these collisions which includes timing ejection of selected ink drops 26 so that selected ink drops 26 pass between non-selected ink drops 28. This timing depends on nozzle row 36, 38 displacement and positioning distance of system 32 from printhead 18. Additionally, positioning distance of system 32 from printhead 18 surface can be adjusted to eliminate collisions depending on the printing application. Non-selected ink drops 28 can also be combined as they travel towards gutter 34 in order to provide additional space for selected ink drops 26. System 32 can be adjusted such that combined non-selected ink drops 28 are captured by gutter 34.

Figure 5:
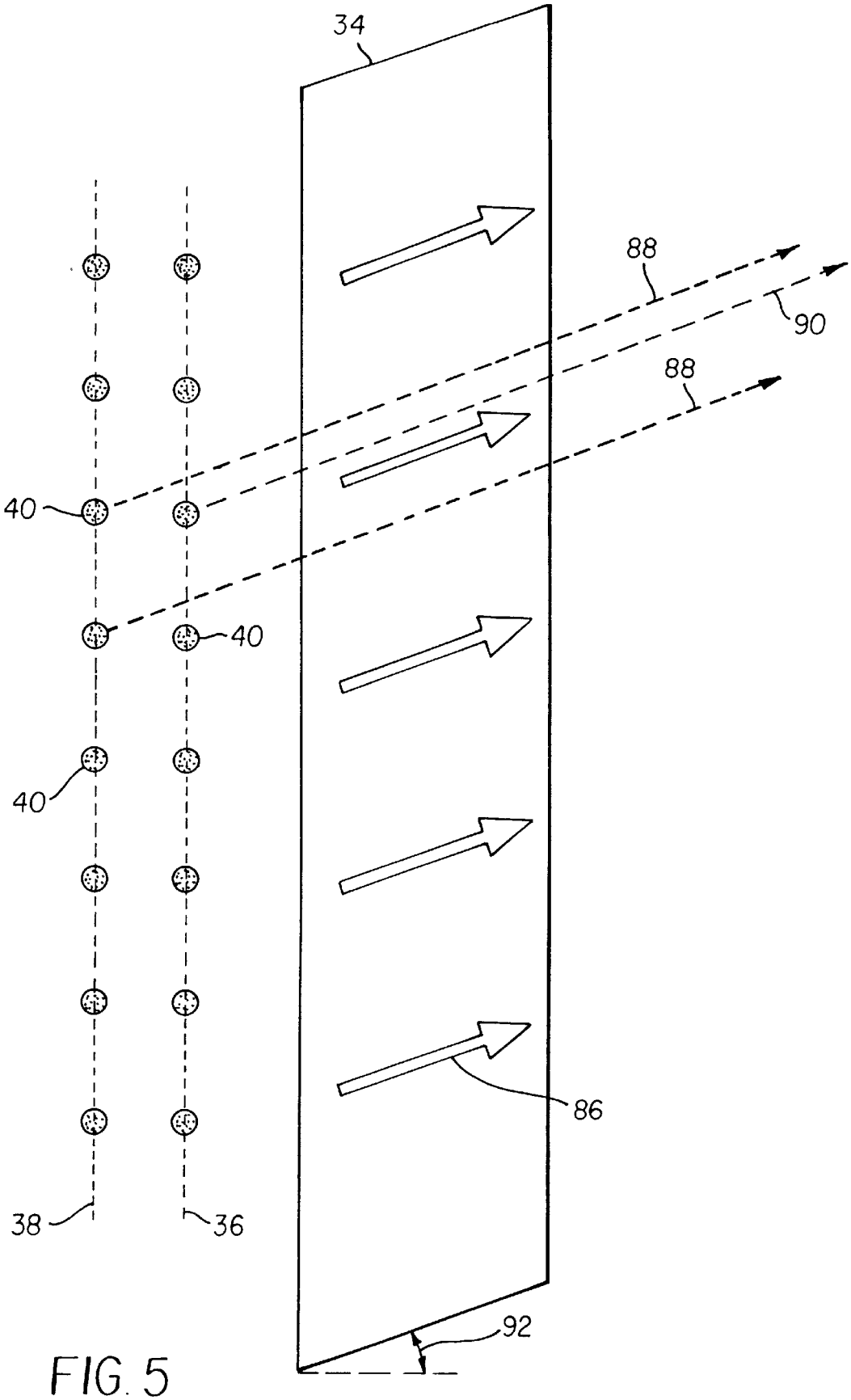
FIG. 5 is a schematic top view of an alternative embodiment of the invention shown in FIG. 2*a;*

Referring to FIG. 5, an alternative embodiment that prevents collisions of selected and non-selected ink drops ejected from redundant nozzle pairs is shown. In this embodiment, direction 86 of force 30 is angled relative to nozzle 40 placement by angling at least a portion of system 32 such that non-selected ink drop path avoids selected ink drop path. Ink drop trajectories 88 do not overlap with ink drop trajectories 90 because selected ink drops are deflected only slightly, if at all. Angle 92 can be any angle sufficient to create non-overlapping ink drop trajectories. Typically, angle 92 is not perpendicular when nozzle rows 36, 38 are not staggered. However, if nozzle rows 36, 38 are staggered, angle 92 can be perpendicular.

Figure 6A:
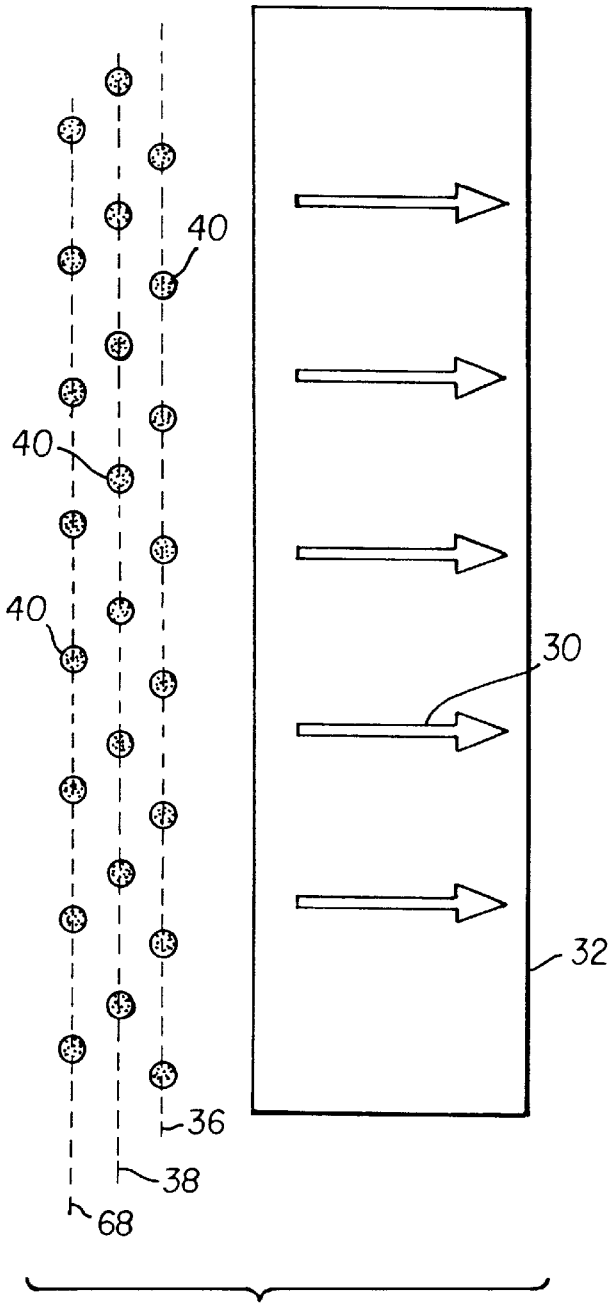
FIG. 6*a* is a schematic top view of an alternative embodiment of the invention shown in FIG. 2*a;*

Referring to FIG. 6*a*, an apparatus similar to the apparatus of FIG. 3*a* is shown. In FIG. 6*a*, three staggered nozzle rows, nozzle row 36, nozzle row 38, and nozzle row 68 are spaced apart in second direction 44 substantially perpendicular to first direction 42. Typically, nozzle spacing is relative to nozzle row 36. However, nozzle spacing can be relative to any nozzle row 36, 38, 68. Each nozzle 40 in each nozzle row 36, 38, 68 is operable to eject selected and non-selected ink drops as described above. Again, non-selected ink drops follow trajectories that lead to gutter 34, regardless of which nozzle row non-selected ink drops originated from. Again, this is because system 32 creates large deflection angles (up to 90 degrees depending on ink drop size) as force 30 of system 32 interacts with selected and non-selected ink drops. This allows spacing between nozzle rows 36, 38, 68 to be increased. The ability to increase nozzle spacing in a two dimensional nozzle array provides additional area for fabrication of each nozzle 40. Increasing the distance between nozzles during fabrication reduces nozzle to nozzle cross-talk during printhead operation.

Figure 6B:
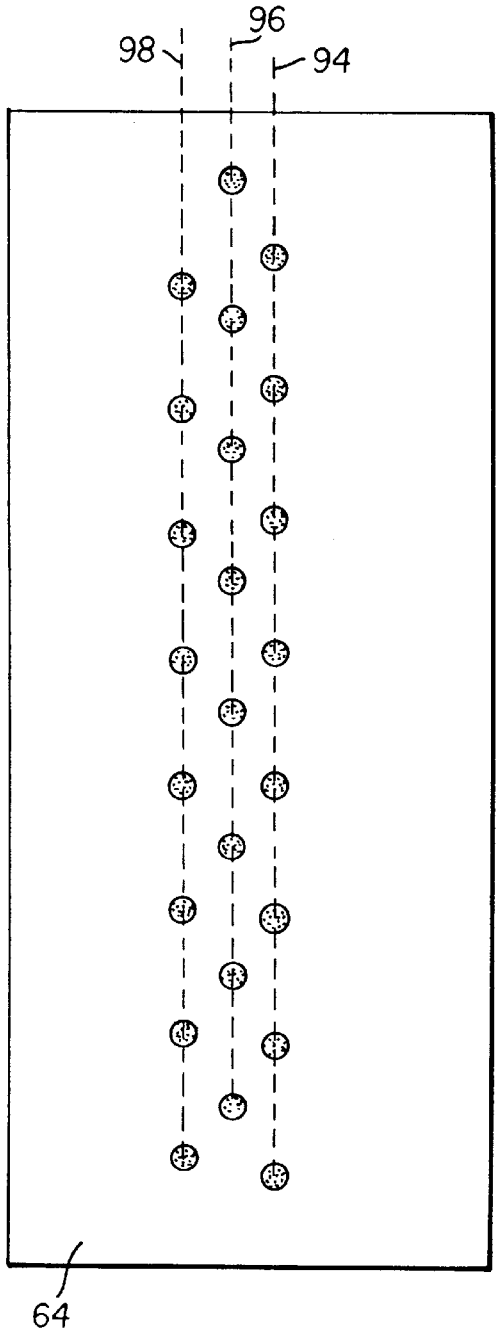
FIG. 6*b* is a schematic view of printed droplets from the embodiment shown in FIG. 6*a;*

Referring to FIG. 6*b*, representative individual print lines 94, 96, 98 on a receiver 64 are shown. By appropriately timing the actuation of nozzle rows 36, 38, 68, ink drops from nozzle rows 36, 38, 68 land on individual print lines 94, 96, 98, respectively, on receiver 64. Ink drop size can be controlled by the frequency of activation of ink drop forming mechanism. Additionally, the size of printed ink drops can be varied such that printed ink drops do not contact each other (as in FIG. 6*b*) or contact each other (as in FIG. 2*d*). Regarding actuation timing, it is important to note that actuation of nozzles 40 of nozzle rows 36, 38, 68 can be nearly simultaneous. However, actuation does not have to be simultaneous in order to compensate for the interaction of force 30 of system 32 with selected and non-selected ink drops. As such, small alterations of actuation timing can be used to form printed ink drop patterns similar to that shown in FIG. 6*b*.

Figure 7A:
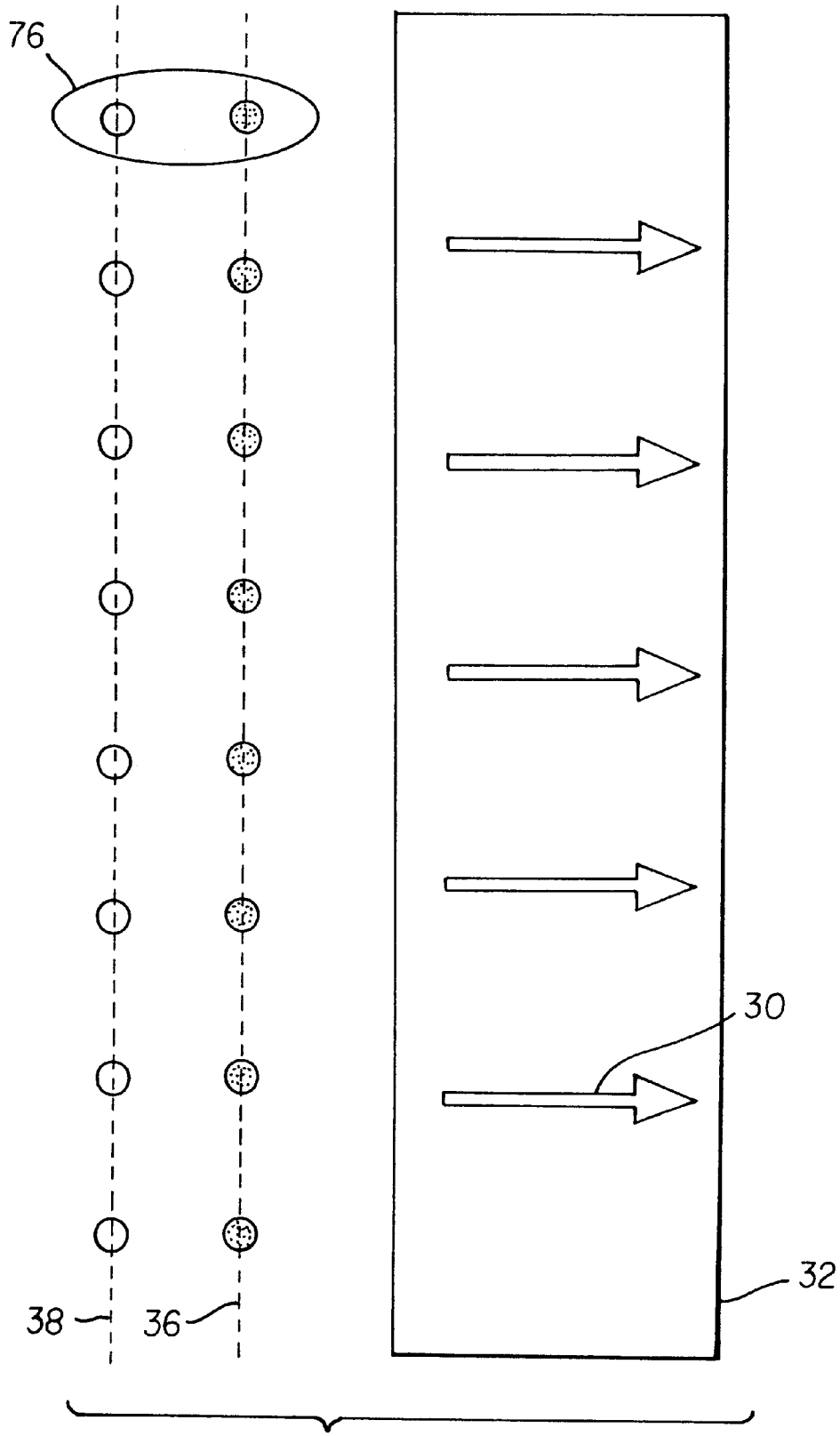
FIG. 7*a* is a schematic top view of an alternative embodiment of the invention shown in FIG. 4*a;*
Figure 7B:
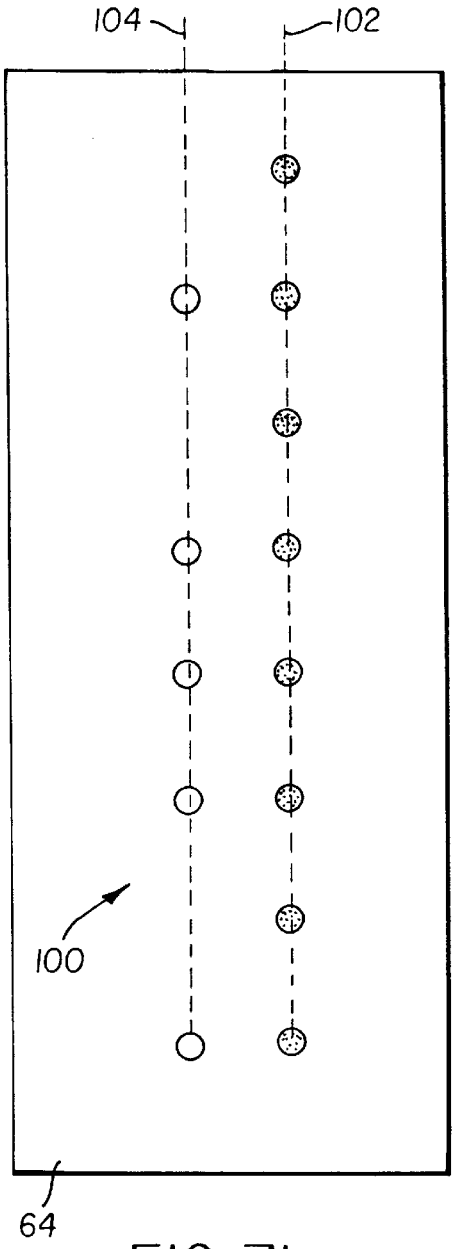
FIG. 7*b* is a schematic view of printed droplets from the embodiment shown in FIG. 7*a*.
Figure 7C:
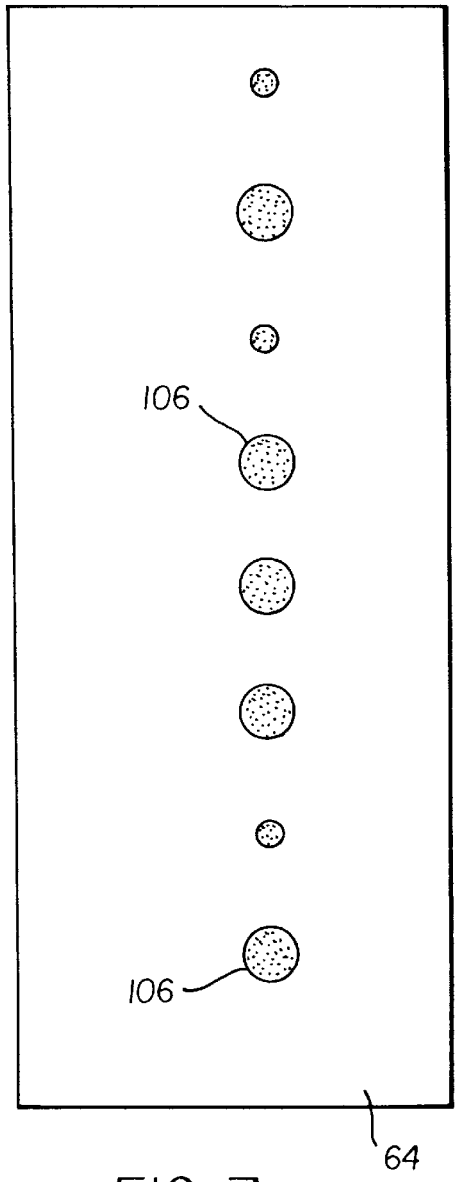
FIG. 7*c* is a schematic view of printed droplets from the embodiment shown in FIG. 7*a*.

Referring to FIGS. 7*a*–7*c*, an apparatus similar to the apparatus of FIG. 4*a* is shown. In FIG. 7*a*, nozzles 40 form redundant nozzle pairs 76 with nozzles 40 of nozzle row 38 being displaced in only second direction 44 from nozzles 40 from nozzle row 36. In this context, redundant nozzle pairs 76 can compensate for individual nozzle failures as discussed above. Redundant nozzle pairs 76 can be fabricated on a printhead using MEMS techniques. In doing so, a precise alignment of the nozzles in redundant nozzle pairs is readily achieved since as these fabrication methods typically involve lithography, well known in the art to render accurate nozzle patterns on a single substrate of a single printhead.

Non-staggered nozzle rows 36, 38 are operable to provide rows of printed ink drops on receiver 64 as shown in FIGS. 7*b* and 7*c*. In FIG. 7*b*, printed ink drop pattern 100 is similar to printed ink drop pattern shown in FIG. 6*b*. However, in FIG. 7*b*, row 104 has selected printed drops omitted from nozzle row 38 (alternatively, nozzle row 36 can have omitted ink drops). Heretofore, this would be particularly difficult to achieve with prior art continuous inkjet printheads because of the need to gutter ink drops from nozzle row 38 through very large deflection angles. Row 102 of printed ink drops corresponds to nozzle row 36. Again, actuation timing of each nozzle 40 in nozzle rows 36, 38, while nearly simultaneous, does not have to be strictly simultaneous, as described above. Additionally, in order to avoid ink drop collisions, system 32 can be angled, as described above with reference to FIG. 5.

Referring to FIG. 7*c*, printhead 18 of FIG. 7*a*, having a two dimensional array of non-staggered nozzles, forming redundant nozzle pairs 76 aligned in second direction 44, can print multiple drops, one ink drop from nozzle row 36 and one ink drop from nozzle row 38, onto the same location 106 of receiver 64. This is achieved by adjusting the actuation timing nozzles 40 in nozzle rows 36, 38, such that printed ink drops ejected from redundant nozzle pairs land on the same location on receiver 64. In this manner, a continuous tone image can be formed from a single continuous inkjet printhead with each nozzle 40 of printhead 18 contributing at most a single drop in any one location on receiver 64. Continuous tone imaging provides an increased rate of ink coverage on receiver 64 as compared to printheads which eject multiple drops from a single nozzle on any one receiver location. This is because a receiver cannot be rapidly advanced while waiting for multiple drops to be ejected from a single nozzle. However, receiver 64 can be rapidly advanced during continuous tone image printing because each nozzle 40 only ejects up to one ink drop onto any one receiver location.

Appropriately timing the actuation of nozzle rows 36 and 38, is typically accomplished using controller 24. Appropriate timing can be achieved by having ink drops 26 ejected from nozzle row 36 ejected earlier in time than ink drops 26 ejected from nozzle row 38. An application specific time separation can be calculated using a formula calculation that determines that the separation time multiplied by the velocity of the receiver with respect to the printhead equals the separation distance between the first and second nozzle rows 36, 38. This relation assumes that nozzle rows 36, 38 are positioned relative to each other sufficiently close such that system 32 displaces ink drops 26, 28 from nozzle rows 36, 38 equally or substantially equally. In this case, nozzle rows are typically separated by moderate distances (for example, distances in the range 10 to 100 microns). For example, given receiver velocities of about 1 m/s and nozzle row separations of about 100 microns, the difference in ejection times in accordance with the formula is about 100 microseconds. For nozzle row separations greater than 100 microns, the separation time calculated form the formula must be increased, due to the fact that the drops from the second row, being further from the end of system 32, experience slightly smaller interaction forces and are deflected less in the direction of receiver motion as compared to drops from the first row. This effect cannot be neglected and should be taken into consideration. For example, given a nozzle row separation of 1 mm, the additional actuation time to be added to the calculated separation time can be several time as large as the calculated separation time. This is because the distances by which drops are displaced by system 32 are as much as 1 mm for typical system velocities of about 1 m/s. The amount of such an increase in the calculated separation time can be readily modeled by the techniques of computational fluid dynamics by assuming the drops to be spheres moving in system 32. Alternatively, the increase can be easily determined emperically by adjusting the increase in separation time so that the ink drops 26 from the nozzle row 36 land on print line 62 on receiver 64 just as do ink drops 26 from nozzle row 38, thus forming a row of printed drops 66, as can be appreciated by one skilled in the art of flow modeling. Once a determination of the correct adjustment is made, its value can be stored for future reference.

The above described nozzle arrays can be fabricated using known MEMS techniques. In doing so, a precise alignment of the nozzles is readily achieved since as these fabrication methods typically involve lithography, well known in the art to render accurate nozzle patterns on a single substrate of a single printhead. Additionally, actuation timing can be accomplished using any known techniques and mechanisms, for example, programmable microprocessor controllers, software programs, etc.

Advantages of the present invention include increased density of printed pixels; increased density of printed rows due to alternate printed drops being printed after neighboring printed drops have been partially absorbed by the receiver; increased ink levels at a given pixel on a receiver; redundant nozzle printing; and increased overall printing speeds.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. A continuous inkjet printing apparatus comprising:

a printhead having a two dimensional nozzle array, said two dimensional nozzle array having a plurality of nozzles;

a drop forming mechanism positioned relative to said nozzles, said drop forming mechanism being operable in a first state to form drops having a first volume travelling along a path and in a second state to form drops having a second volume travelling along said path, said second volume being greater than said first volume;

a system which applies force to said drops travelling along said path, said force being applied in a direction such that said drops having said first volume diverge from said path; and a gutter positioned relative to said path, said gutter being shaped to collect one of said drops having said first volume and said drops having said second volume.

2. The apparatus according to claim 1, wherein two dimensional nozzle array includes a first nozzle row and a second nozzle row displaced from said first nozzle row.

3. The apparatus according to claim 2, wherein said first nozzle row extends in a first direction, said second nozzle row extending in said first direction and being displaced relative to said first nozzle row in said first direction.

4. The apparatus according to claim 1, further comprising a controller.

5. The apparatus according to claim 4, wherein said controller is configured to actuate said drop forming mechanism such that said drops are formed at a plurality of predetermined times.

6. The apparatus according to claim 1, wherein said force is applied in a direction substantially perpendicular to said path.

7. The apparatus according to claim 1, wherein said force is a positive pressure force.

8. The apparatus according to claim 1, wherein said drop forming mechanism includes a heater.

9. The apparatus according to claim 8, wherein said heater is activated at a plurality of frequencies.

10. The apparatus according to claim 1, wherein said force is a negative pressure force.

11. A method of increasing ink drop density of a printed line on a receiver comprising:

forming a first row of drops travelling along a first path, some of the drops having a first volume, some of the drops having a second volume;

forming a second row of drops travelling along a second path, some of the drops having a first volume, some of the drops having a second volume;

causing the drops having the first volume from the first and second rows of drops to diverge from the first and second paths; and causing the drops having the second volume from the first and second rows of drops to impinge on a location of the receiver.

12. The method according to claim 11, further comprising displacing the second row of drops relative to the first row of drops.

13. The method according to claim 12, wherein displacing the second row of drops relative to the first row of drops includes displacing the second row in a first and second direction relative to the first row.

14. The method according to claim 11, wherein causing the drops having the second volume from the first and second rows of drops to impinge on a line on the receiver includes controlling the formation timing of the second row of drops.

15. The method according to claim 14, wherein causing the drops having the first volume from the first and second rows of drops to diverge from the first and second paths includes applying a force to the first and second paths.

16. The method according to claim 15, wherein causing the drops having the first volume from the first and second rows of drops to diverge from the first and second paths includes applying a force in a direction substantially perpendicular to the first and second paths.

17. The method according to claim 11, wherein causing the drops having the second volume from the first and second rows of drops to impinge on a location of the receiver includes causing the drops to impinge on a line of the receiver such that a resulting printed ink drop line includes alternating drops from the first and second rows.

18. The method according to claim 11, wherein causing the drops having the second volume from the first and second rows of drops to impinge on a location of the receiver includes causing the drops to impinge on an area of the receiver in a pattern corresponding to the two dimensional nozzle array.

19. A continuous inkjet printing apparatus comprising:

a printhead having a two dimensional nozzle array, said two dimensional nozzle array having a first nozzle row being disposed in a first direction and a second nozzle row being disposed displaced and offset relative to said first nozzle row;

a drop forming mechanism positioned relative to said nozzle rows, said drop forming mechanism being operable in a first state to form drops having a first volume travelling along a path and in a second state to form drops having a second volume travelling along said path, said second volume being greater than said first volume;

a system which applies force to said drops travelling along said path, said force being applied in a direction such that said drops having said first volume diverge from said path; and a gutter positioned relative to said path, said gutter being shaped to collect one of said drops having said first volume and said drops having said second volume.

20. The apparatus according to claim 19, wherein said second nozzle row is offset in said first direction.

21. The apparatus according to claim 19, wherein each of said nozzle rows includes a plurality of nozzles, said second nozzle row being offset such that at least one nozzle from said second nozzle row is positioned in between adjacent nozzles from said first nozzle row.

22. The apparatus according to claim 19, wherein said force is a negative pressure force.

23. A continuous inkjet printing apparatus comprising:

a printhead having two nozzle rows, each nozzle row having a plurality of nozzles, a first nozzle row being displaced relative to a second nozzle row in a first direction and aligned relative to said second nozzle row in a second direction;

a drop forming mechanism positioned relative to said nozzles, said drop forming mechanism being operable in a first state to form drops having a first volume travelling along a path and in a second state to form drops having a second volume travelling along said path, said second volume being greater than said first volume;

a system which applies force to said drops travelling along said path, said force being applied in a direction such that said drops having said first volume diverge from said path, said system being disposed such that said drops having said first volume and said second volume travel along distinct drop trajectories; and a gutter positioned relative to said path, said gutter being shaped to collect one of said drops having said first volume and said drops having said second volume.

24. The apparatus according to claim 23, wherein at least a portion of said force is angled such that that said drops having said first volume and said second volume travel along distinct drop trajectories.

25. The apparatus according to claim 24, wherein said angle is greater than 0 degrees and less than 90 degrees.

26. The apparatus according to claim 23, wherein said force is a positive pressure force.

27. The apparatus according to claim 23, further comprising a controller.

28. The apparatus according to claim 27, wherein said controller is configured to actuate said drop forming mechanism such that said drops are formed at a plurality of predetermined times.

29. The apparatus according to claim 23, wherein said drop forming mechanism includes a heater.

30. The apparatus according to claim 29, wherein said heater is activated at a plurality of frequencies.

31. The apparatus according to claim 23, wherein said force is a negative pressure force.

32. A method of increasing ink drop density in a continuous inkjet printer having a two dimensional nozzle array comprising:

forming a first row of drops travelling along a first path, some of the drops having a first volume, some of the drops having a second volume;

forming a second row of drops travelling along a second path, some of the drops having a first volume, some of the drops having a second volume;

causing the drops having the first volume from the first and second rows of drops to diverge from the first and second paths along distinct drop trajectories; and causing the drops having the second volume from the first and second rows of drops to impinge on predetermined areas on the receiver.

33. The method according to claim 32, further comprising displacing the second row of drops in a direction relative to the first row of drops such that the second row of drops is in line with the first row of drops when viewed along the first direction.

34. The method according to claim 32, wherein causing the drops having the first volume from the first and second rows of drops to diverge from the first and second paths includes applying a force to the first and second paths.

35. The method according to claim 34, wherein causing the drops having the first volume from the first and second rows of drops to diverge from the first and second paths along distinct drop trajectories includes angling a force that interacts with the drops such that distinct drop trajectories are created.

* * * * *